United States Patent [19]

Deutsch

[11] 4,246,822

[45] Jan. 27, 1981

[54] DATA TRANSFER APPARATUS FOR DIGITAL POLYPHONIC TONE SYNTHESIZER

[75] Inventor: Ralph Deutsch, Sherman Oaks, Calif.

[73] Assignee: Kawai Musical Instrument Mfg. Co. Ltd., Hamamatsu, Japan

[21] Appl. No.: 10,946

[22] Filed: Feb. 9, 1979

[51] Int. Cl.[3] ..... G10H 7/00

[52] U.S. Cl. ..... 84/1.01; 84/1.03

[58] Field of Search ..... 84/1.01, 1.03

[56] References Cited

U.S. PATENT DOCUMENTS

| | | | |
|---|---|---|---|
| 3,763,364 | 10/1973 | Deutsch et al. | 84/1.03 X |
| 4,022,098 | 5/1977 | Deutsch et al. | 94/1.03 |
| 4,084,472 | 4/1978 | Niimi | 84/1.01 |
| 4,085,644 | 4/1978 | Deutsch et al. | 84/1.01 |
| 4,135,422 | 1/1979 | Chibana | 84/1.01 |

*Primary Examiner*—Stanley J. Witkowski

*Attorney, Agent, or Firm*—Christie, Parker & Hale

[57] ABSTRACT

In a musical instrument having one or more tone generators in which a plurality of data words corresponding to the amplitudes of a corresponding number of evenly spaced reference points defining the waveform of one cycle of an audio signal are transferred sequentially from a note register to a digital-to-analog converter in repetitive cycles at a rate proportional to the pitch of the tone being generated, apparatus for loading a new set of data words in the note register without interrupting the transfer of data words from the note register to the converter is provided. The note register is divided into two sections. One section is loaded with data words defining half a cycle of an audio signal. By taking advantage of half cycle symmetry of the waveform, the other half of the note register is loaded at the same time using the same data words in reverse order. By reducing the number of data words transferred to the note register by half, the rate requied to transfer the words sequentially into the note register can be reduced to an acceptable level, while limiting the total time to effect a load so as not to interrupt the normal sequential transfer of data words from the register to the digital-to-analog converter.

9 Claims, 4 Drawing Figures

DATA TRANSFER APPARATUS FOR DIGITAL POLYPHONIC TONE SYNTHESIZER

FIELD OF THE INVENTION

This invention relates to a polyphonic tone synthesizer, and more particularly, is concerned with improved apparatus for transferring recomputed waveform data to the individual tone generators without interruption of the audio output of the respective tone generators.

BACKGROUND OF THE INVENTION

In U.S. Pat. No. 4,085,644 there is described a polyphonic tone synthesizer in which a master data set is computed and stored in a main register from which it is transferred to note registers of a plurality of tone generators. The master data set defines the amplitudes of equally spaced points along a half cycle of the audio waveform of the musical tones being generated. Each tone generator receives the words in the master data set and applies them to a digital-to-analog converter at a rate determined by the fundamental pitch of the respective tones being generated by the polyphonic tone synthesizer.

One of the features of the synthesizer circuit, as described in the above-identified patent, is that the transfer of successive words from the master data set in the main register to an individual note register in the respective tone generators is synchronized with the transfer of words from the note register to the digital-to-analog converter in respective tone generators. This feature allows the master data set defining the waveform to be recomputed and loaded in the respective tone generators without interrupting the generation of the respective musical notes by the tone generators, thus permitting the waveform of a musical tone to be changed with time without interrupting the resulting musical tone.

One problem with the arrangement described in the above-identified patent is that the rate at which the waveform can be varied as a function of time is limited by the time required to transfer the data from the main register to the note registers in each of the tone generators. The transfer time in turn is limited for each tone generator by the fundamental frequency of the tone being generated. The total transfer time for each tone generator is equal to one period at the fundamental frequency of the tone being generated. If all the tone generators, e.g., 12 generators, are generating tones simultaneously in the lower registers, the total time to load the master data set in all of the tone generators can become appreciable using the arrangement described in the above-identified patent.

One solution to reducing the transfer time would be to transfer the entire master data set into the note register of a tone generator in a period of time which was less than the time required to transfer successive digital values from the note register to the digital-to-analog converter of the tone generator. This would permit the master data set in the note register to be updated without interrupting the flow of data to the digital-to-analog converter and hence without interrupting the resulting audio signal at the output of the tone generator. However, to generate audio waveforms having 32 harmonics, a minimum of 64 data points is required for the master data set in the note register to define one cycle having the desired waveshape. To reproduce a musical note for the highest note on the musical instrument, which preferably is the note $C_7$, corresponding to a fundamental frequency of 2093 hz. would require a transfer frequency of at least 8.57 mhz., i.e., $2093 \times 64 \times 64$. This is too high a transfer frequency for low-cost microelectronic devices preferably used in electronic musical instruments.

SUMMARY OF THE INVENTION

The present invention is directed to an improved arrangement for transferring the master data set from the main register to the note registers of the respective tone generators in a polyphonic tone synthesizer of the type described in the above-identified patent. By the present invention, the transfer time is not tied to the note frequency, as in the arrangement described in the above-identified patent. The transfer rate, while being substantially higher than 64 times the fundamental frequency of the note being generated, is nevertheless at least half the 8.57 mhz. frequency discussed above. The transfer time for each tone generator is independent of the note clock frequency for the respective tone generators. At the same time the transfer operation does not interfere with or disrupt the periodic transfer of successive data points to the digital-to-analog converters at the respective note clock frequencies. Thus the present invention permits the waveshape of a tone generator to be modified as a function of time at a rate which is substantially higher than has heretofore been achieved, while at the same time limiting the transfer rate to frequencies which are practical for low-cost microelectronic devices.

This is achieved, in brief, by dividing the note register of each tone generator into two halves. The computed data points defining a half cycle of the desired waveform are transferred sequentially to one half of the note register during the transfer time. The transfer rate is controlled independently of the note frequency. The other half of the note register is loaded with the same data points but in the reverse order. The other half can be loaded either simultaneously with the loading of the one half or can be subsequently loaded from the one half of the note register after the transfer to the one half is completed. In either case, the transfer rate for loading the data points in the master data set sequentially into a tone generator is at least cut in half for a given time interval to complete the transfer compared to transfer of a complete cycle of data points as with prior art. Moreover, the allowable time for transfer is not limited by the highest audible note frequency of the instrument where the transfer is initially to one half only of the note register, since the one half is available for receiving the data points during the time the other half is transferring data points to the digital-to-analog converter of the tone register.

BRIEF DESCRIPTION OF THE DRAWINGS

For a more complete understanding of the invention, reference should be made to the accompanying drawings, wherein.

DETAILED DESCRIPTION

Figure 1:
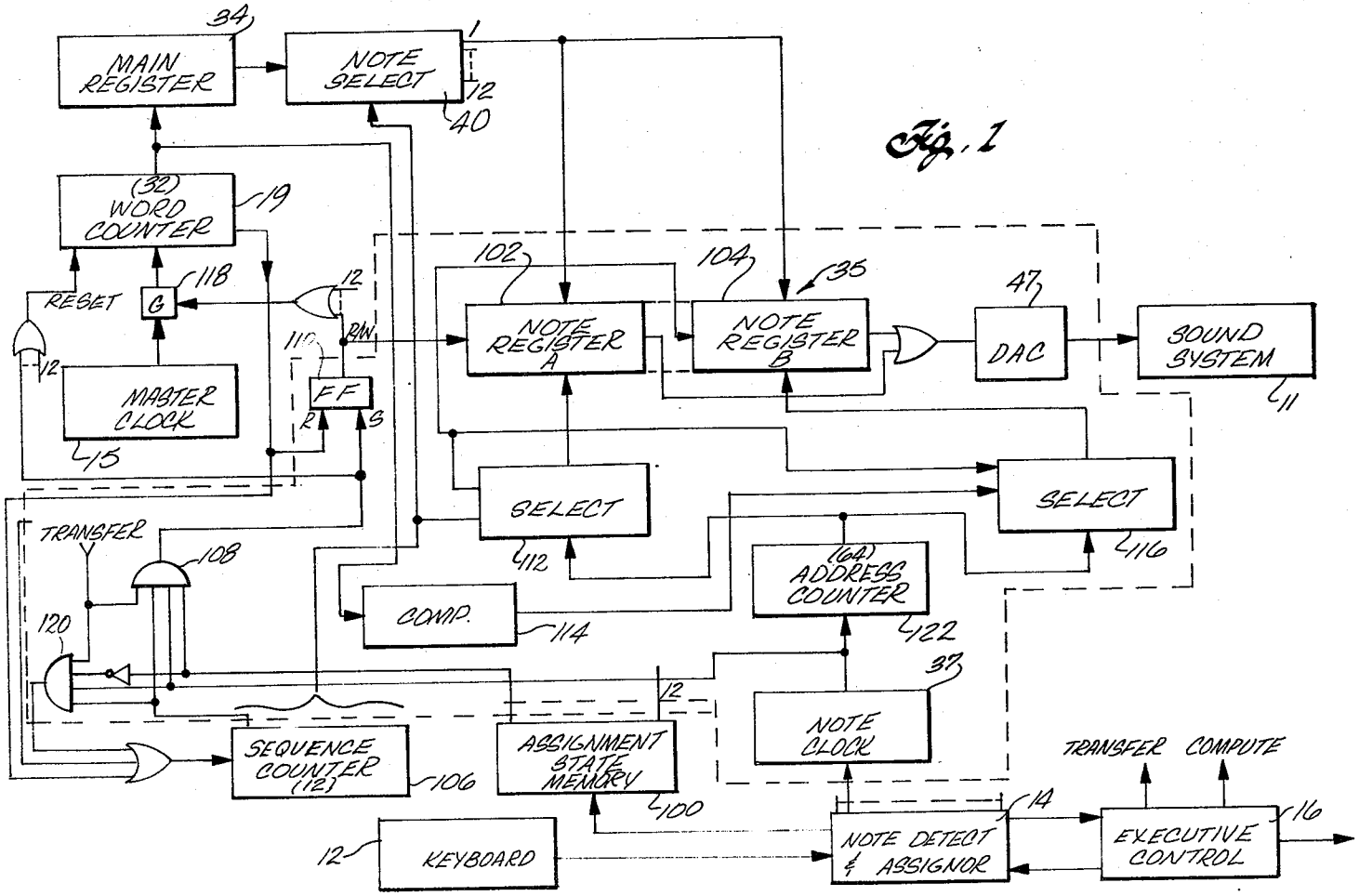
FIG. 1 is a schematic block diagram of one embodiment of the present invention.

The embodiments of FIGS. 1–4 are shown and described as modifications to the polyphonic tone synthesizer described in detail in U.S. Pat. No. 4,085,644, hereby incorporated by reference. All two-digit reference numbers used in the drawings correspond to the similarly numbered elements in the disclosure of the above-identified patent.

As described in the patent, the polyphonic tone synthesizer includes an instrument keyboard 12 corresponding to the conventional keyboard of an electronic organ, for example. By depressing one or more keys on the instrument keyboard, a note detect and assignor circuit 14 stores the note information of the keys that have been depressed and assigns each note to one of twelve separate tone generators. The note detect and assignor circuit is described in detail in U.S. Pat. No. 4,022,098, also hereby incorporated by reference. When one or more keys has been depressed, an executive control circuit 16 initiates a computation mode in which a master data set of 32 words is computed and stored in a main register 34. The 32 words are coded in value to correspond to the amplitudes of 32 equally spaced points of one-half cycle of the audio waveform of the tone to be generated by the tone generators. The manner in which the polyphonic tone synthesizer computes the waveform defining master data set is described in detail in U.S. Pat. No. 4,085,644.

At the completion of the computation mode, the executive control 16 initiates a transfer mode in which the master data set stored in the main register 34 is transferred to a note register 35 in the assigned tone generators. An assignment state memory 100 stores the assignment status of each of the twelve tone generators according to the status of the assignment bits stored in an assignment memory in the note detect and assignor circuit 14, as described in detail in the above-identified U.S. Pat. No. 4,022,098. The note register 35 stores 64 words corresponding to one complete cycle of the audio tone to be generated. As described in U.S. Pat. No. 4,085,644, the 32 words in the master data set in the main register 34 are expanded to 64 words in the note register 35 during the transfer operation by using the even or odd symmetry of the Fourier series from which the master data set is computed. If even symmetry is used, that is, all cosine functions are used in the Fourier series, it is only necessary to reverse the order of the 32 data points of the master data set to provide an additional 32 words defining the second half cycle in the note registers. If odd symmetry is used, that is, all sine functions are used in the Fourier series, not only must the order of the second group of 32 data points be reversed, but the algebraic sign must also be reversed, such as by using a 2's complement circuit.

Once the 64 data points defining one complete cycle of the desired audio waveshape are stored in the note register 35, the data points are read out of the note register 35 in sequence and applied to a digital-to-analog converter (DAC) 47 and converted into an analog voltage of the desired audio waveshape which is applied to the sound system 11. The data points are transferred out of the note register 35 at a clock rate controlled by an associated note clock 37 in each of the tone generators. The note clock 37 is a voltage controlled oscillator whose frequency is set to 64 times the fundamental frequency of the keyed note on the keyboard. Thus all 64 data points are transferred to the digital-to-analog converter 47 in a time interval corresponding to one period at the pitch or fundamental frequency of the selected note.

As further described in the above-identified U.S. Pat. No. 4,085,644, it is desirable to be able to continuously recompute the master data set in the main register 34 and reload the note register 35 while the associated key on the keyboard remains depressed. This must be done without interrupting the flow of data points to the digital-to-analog converter at the note clock rate. This was accomplished by transferring the data points in the master data set in the main register 34 to the note register 35 at the note clock rate so that as a word was read out of the note register to the digital-to-analog converter, a new data point word was loaded into the note register 35. After a complete set of 64 data points was read out, therefore, a complete new set of 64 data points was already loaded and available in the note register 35 for generation of the next and successive cycles of the audio tone. Thus the transfer time for a tone generator was determined by the frequency of the note clock 37, which, particularly for the lower frequency notes, involves a relatively long time.

The present invention is directed to an arrangement for transferring the master data set in the main register 34 to the note register 35 in a time less than the time required to transfer all of the 64 data points from the note register 35 to the digital-to-analog converter 47 for the highest frequency note in the keyboard 12. The highest frequency note typically is the note $C_7$ having a fundamental frequency of 2093 hz. However only the 32 data points in the main register 34 need to be transferred during this time interval and not the full cycle of 64 data points normally loaded in the note register 35.

The transfer operation according to the present invention, as shown in FIG. 1, is accomplished by forming the note register 35 in each tone generator from two separately addressable random access memories 102 and 104, referred to as note register A and note register B, respectively. While the circuitry for only one tone generator, enclosed within the dash line in FIG. 1, is shown, it will be understood that twelve such tone generators are normally provided in the preferred embodiment of the polyphonic tone synthesizer.

When the executive control 16 initiates a transfer mode, signaled on the output line labeled "transfer" in FIG. 1, it causes the master data set computed and stored in the main register 34 to be transferred to the note register 35 in each of the assigned tone generators in sequence. A sequence counter 106 activates the transfer cycle for each of the twelve tone generators in timed sequence. Initially the sequence counter 106 activates the first tone generator during the transfer mode.

The transfer cycle from the main register 34 to the first tone generator is initiated by the output of a logical AND circuit 108 which senses that the executive control has initiated a transfer mode, that the sequence counter 106 is set to 1, and that the assignment state memory indicates that the first tone generator has been assigned on a key on the keyboard 12. If all these conditions are true, the next clock pulse from the note clock 37 applied to the AND circuit 108 sets a control flip-flop 110 in the first tone generator. At the same time it causes the word counter 19 to be reset to 1 for addressing the first data point word in the main register 34.

With the control flip-flop 110 set, the note registers A and B are set to commence a Write operation for storing each word addressed and read out of the main register 34 in both the note registers A and B. The output of the control flip-flop 110 also causes a select circuit 112 to select the output of the word counter 19 as the address applied to note register A. This causes the first word in the main register 34 to be stored in the first word position in the note register A in the tone generator selected by the sequence counter 106 by means of the note select circuit 40. At the same time, the same word is stored in the 64th word position in note register B. The note register B is addressed by complementing the output of the word counter 19 by a complement circuit 114 and applying the complemented address from the word counter to the note register B through a select circuit 116.

As each word in the main register 34 is written in note register A and note register B, the word counter 19 is counted up one by the next pulse from the master clock 15 applied to the word counter 19 through a gate 118 in response to the setting of the control flip-flop 110. After 32 pulses from the master clock 15, the word counter produces an overflow pulse which resets the control flip-flop 110 and advances the sequence counter 106 to activate the next tone generator in sequence. If the next tone generator has not been assigned, as indicated by the assignment state memory 100, a logical AND circuit 120 in the unassigned tone generator causes the sequence counter 106 to be advanced immediately to the next tone generator in sequence.

When the control flip-flop 110 is reset, the note registers A and B return to the Read mode of operation in which the 64 locations in the two sections of the note register 35 are addressed in sequence by an address counter 122 which counts up in response to clock pulses from the note clock 37. By making the master clock frequency 32 times the highest frequency of the note clock 37, all 32 words of the master data set in the main register are transferred to both the note register A and note register B between successive note clock pulses. Assuming the highest note on the keyboard is $C_7$, the highest frequency of the note clock is $64\times2093$ hz. The frequency of the master clock is therefore $64\times2093\times32=4.29$ mhz., which is within an acceptable frequency range for low-cost microelectronic devices. By insuring that the transfer takes place between successive note clock pulses of the tone generator, the present invention permits the transfer of data points to the digital-to-analog converter to go forward without interruption during the reloading of the note register from the main register.

Figures 2, 3:
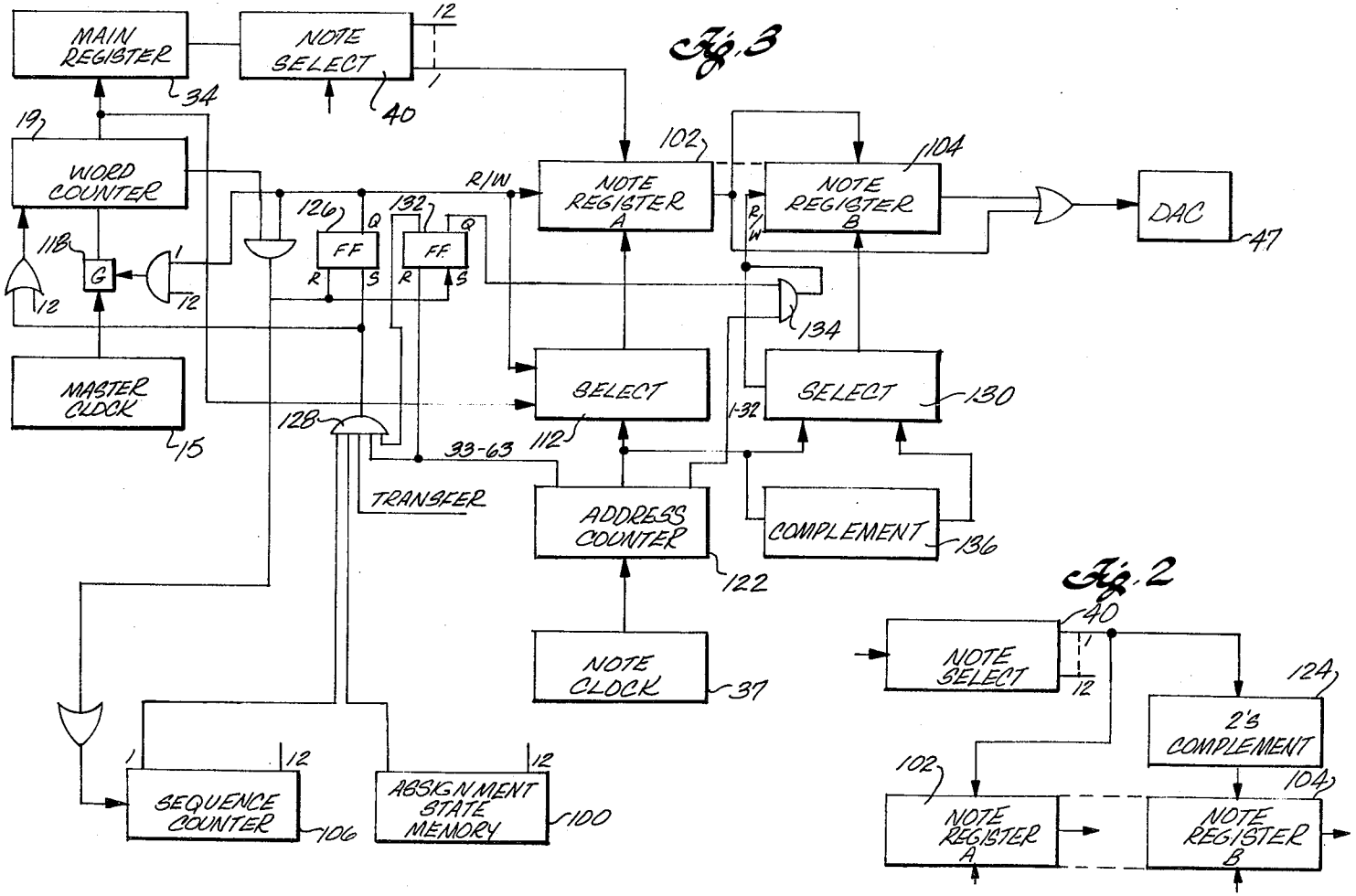
FIG. 2 is a schematic block diagram of a modification to the circuit arrangement of FIG. 1.
FIG. 3 is a further modification using shift registers for the main register and note registers of the tone generators.

FIG. 2 shows a modification to the circuit of FIG. 1 wherein the master data set in the main register 34 is computed using sine functions rather than cosine functions. Since the two half cycles of a sine function have odd symmetry, it is necessary not only to reverse the sequence of data points for the second half cycle, but also to reverse the algebraic sign. This is accomplished, as shown in FIG. 2, by passing each data point through a 2's complement circuit 124 before storing the word in note register B. No other modification to the circuit of FIG. 1 is required.

An alternative embodiment of the invention is shown in FIG. 3. In this embodiment, transfer of the master data set overlaps transfer of data to the digital-to-analog converter. At the start of a transfer mode, a logical AND circuit 128, in response to the sequence counter 106 in the assignment state memory 100, sets the control flip-flop 126 if the address counter 122 is pointing to an address in note register B, namely addresses 33–63. If the address is 64, the last word in the list, the control flip-flop 126 is not set. This is to avoid having a transfer interrupted when the address changes from 64 back to 1. With the control flip-flop 126 set, the note register A is put in the Write state and the select circuit 112 selects addresses from the word counter 19, rather than from the address counter 122. At the same time, master clock pulses are applied to the word counter through the gate 118 to advance the word counter. Thus, with each master clock pulse, a word is transferred from the main register 34 to the note register A in the same manner as described above in connection with FIG. 1. When all 32 words are transferred to the note register A, the overflow pulse from the word counter 19 resets the control flip-flop 126 and advances the sequence counter 106 to the next tone generator.

During the time the master data set is being transferred to the note register A, the note register B continues to be addressed by the address counter 122 through a select circuit 130 and note register B remains in the Read state. Thus the words in the note register B continue to be transferred in sequence to the digital-to-analog converter 47 from addresses 33–64.

When the control flip-flop 126 is reset, a second control flip-flop 132 is set turning on one input to a logical AND circuit 134. When the address counter 122 returns to address 1, so as to begin addressing note register A, the output from the AND circuit 134 sets the note register B into the Write state. At the same time, the select circuit 130 selects the complemented addresses from the counter 122 to address the note register B, as provided by a complement circuit 136. As each word is read out of the note register A to the digital-to-analog converter 47, it is written into the note register B in the reverse order by virtue of the complemented addresses. After the address counter 122 addresses and reads all 32 words in the note register A, the same set of words will have been stored in the note register B but in the reverse order. The control flip-flop 132 is then reset, and the address counter 122 continues to address the words in note register B in the normal sequence for transfer to the digital-to-analog converter 47.

It will be seen that the transfer of the master data set to the tone generator does not interfere with the periodic transfer of data points to the digital-to-analog converter at the note clock rate. The transfer from the main register in the arrangement of FIG. 3 is therefore not limited to a time interval between successive note clocks. Thus in the arrangement of FIG. 3, it is possible to operate the master clock 15 at a lower frequency than in the arrangement of FIG. 1.

Figure 4:
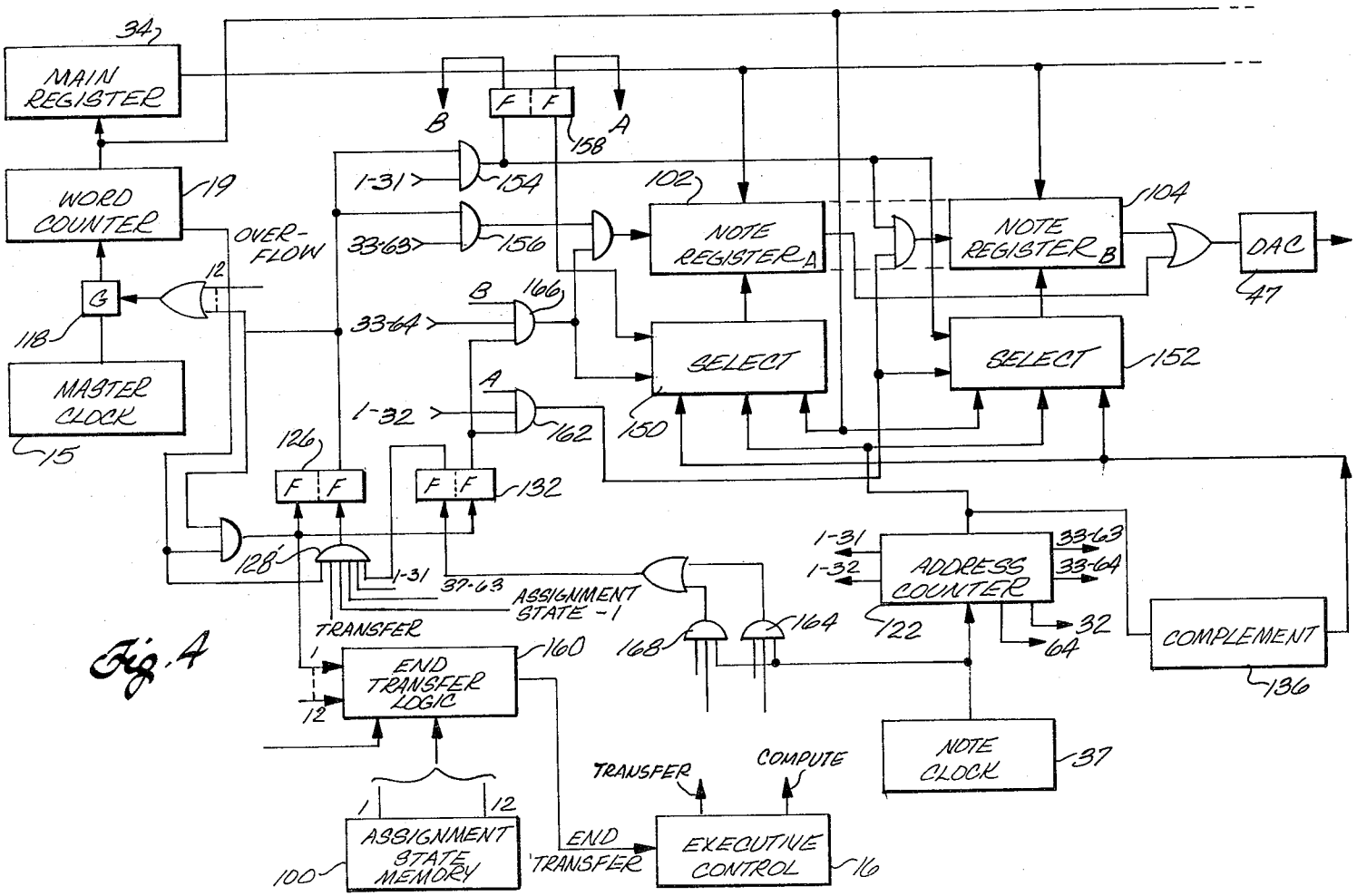
FIG. 4 is a schematic block diagram of an alternative embodiment of the present invention.

With the arrangement of FIG. 3, it is possible to load a number of tone generators from the main register in parallel rather than in sequence. However, since the tone generators are asynchronous, at any given time, either note register A or note register B of a tone generator may be the note register that is available for transfer. In the arrangement of FIG. 4, provision is made for effecting transfer from the main register 34 to either note register A or note register B, depending upon which note register is available at the time a transfer is initiated.

Referring to FIG. 4 in detail, the control flip-flop 126 in any of the tone generators (only one of which is shown in FIG. 4) is set in response to the output of a logical AND circuit 128'. The logical AND circuit 128' senses that the executive control has initiated the transfer mode, that the assignment state memory indicates that the particular tone generator has been assigned to generate a tone in response to operation of a key on the keyboard, that the address counter 122 is not addressing the last word in the note register A or note register B, and that the word counter 19 is set to start a new counting cycle. With the control flip-flop 126 set in any of the tone generators, the gate 118 initiates the counting of the word counter 19 by the clock pulses from the master clock 15. Thus the word counter 19 addresses, in sequence, the master data set in the main register 34, causing the words to be read out of the main register at the master clock rate over a common bus which is connected to the input of the note registers 102 and 104 in all of the tone generators.

At the same time the words are being read out of the main register 34, the word counter 19 is addressing one or the other of the note registers A and B through either select circuit 150 or select circuit 152 for writing the words received from the main register in either note register A or note register B, depending on which of the note registers is not currently being addressed by the address counter 122. This condition is determined by a pair of logical AND circuits 154 and 156 which sense that the control flip-flop 126 has been set and that the address counter 122 is currently addressing locations 1–31 in note register A or addressing locations 33–63 in note register B. The output of AND circuit 154 puts note register B in the Write state and causes the select circuit 152 to select the addresses from the word counter 19 to address note register B. Thus the transfer of the master data set is to the note register B. However, if the output of the logical AND circuit 156 goes true, it sets the note register A to the Write state and causes the select circuit 150 to select addresses from the output of the word counter 19 to address note register A, so that the transfer takes place from the main register 34 to note register A. At the same time a control flip-flop 158 is set to indicate that the transfer of the master data set took place either to note register A or note register B.

When all of the words have been transferred, the word counter produces an overflow signal indicating that it has reached the maximum count and resetting the control flip-flop 126. This completes the transfer of the master data set into the tone generator, but not necessarily into all of the tone generators. As noted above, the initial setting of the control flip-flop 126 in some of the tone generators may be delayed by as much as one note clock interval because the address counter was either in the count 32 state or the count 64 state at the time the executive control 16 initiated a transfer. To determine when the transfer has been completed in all of the tone generators, the overflow signal which resets the control flip-flop 126 in each of the tone generators is applied to an End Transfer logic circuit 160 which determines when the control flip-flops 126 in all of the assigned tone generators have been reset and signals an end of transfer to the executive control 16.

At the same time the control flip-flop 126 is reset, a control flip-flop 132 is set in the same manner as described above in connection with FIG. 3 for initiating the transfer of the master data set loaded in one of the two registers 102 or 104 into the other of the two registers in the reverse order at the note clock rate. As noted above, the control flip-flop 158 indicates into which of the two note registers A or B the master data set has been loaded from the main register 34. Assuming the master data set was originally transferred into note register A, when the address counter begins addressing note register A to transfer words in sequence to the digital-to-analog converter 47, the words are written into note register B in the reverse order, as described above in connection with FIG. 3. To this end, a logical AND circuit 162 senses that control flip-flop 158 was set to A and that the address counter 122 is now set to address the first word in note register A. The output of the AND circuit 162 places the note register B in the Write state and at the same time causes the select circuit 152 to select the address from the output of the complement circuit 136 for addressing note register B. Thus as each word is read out of note register A to the digital-to-analog converter 47 by the address counter 122, the same word is written in note register B in the complemented address location. When the address counter 122 reaches address 32, the next note clock pulse applied to a logical AND circuit 164 causes the control flip-flop 132 to be reset.

Alternatively, if the control flip-flop 158 is set to state B, indicating that note register B was loaded initially from the main register 34, the output of a logical AND circuit 166 places the note register A in the Write state and causes the select circuit 150 to select the complemented address from the output of the complement circuit 136. When the address counter 122 reaches address 64 in note register B, the next note clock applied to a logical AND circuit 168 causes the control flip-flop 132 to be reset.

From the above description of FIG. 4 it will be seen that the maximum time in which the word counter 19 and main register 34 are tied up in a transfer operation is equal to 1 period at the highest note clock period (the time required to transfer 32 words at the master clock rate) plus 1 note clock period at the note clock period for the lowest frequency note on the keyboard (the maximum time for the address counter to advance from 32 to 33 or 64 back to 1). Within this maximum time interval, all of the tone generators can be loaded with a new master data set, after which the executive control can initiate another Compute mode.

What is claimed is:

1. A polyphonic tone synthesizer comprising: a plurality of tone generators, each tone generator including a note register for storing a group of data words corresponding to the relative amplitudes of a plurality of points defining one full cycle of an audio signal, a digital-to-analog converter, and means transferring the data words sequentially from the note register to the converter at a rate proportional to the pitch of the tone being generated, the note register having at least two sections, each section storing a portion of said group of data words; means for generating and storing a group of data words defining a portion of a cycle of an audio signal; and means transferring sequentially from said last-named means the group of words defining a portion of a cycle to one of said note register sections in one or more of the tone generators at a rate which is substantially higher than the highest rate at which data words are transferred from a note register to a converter without interruption of the transfer of data words from the corresponding note register of the associated converter.

2. Apparatus of claim 1 wherein said last-named means transferring the group of words includes means transferring each word in said group of words in sequence simultaneously to both of the sections of a note register.

3. Apparatus of claim 1 further including means for transferring each word in the group of words loaded in said one section of a tone generator to the other section simultaneously with the transfer of each word in said one section to the converter.

4. Apparatus of claim 3 wherein the words transferred from one section to the other are stored in the reverse order in the other section.

5. Apparatus of claim 1 wherein said last-named means transferring sequentially the group of words to one of said note register sections includes means for transferring each word to all of the note registers in parallel.

6. In a musical instrument having one or more tone generators in which a plurality of data words corresponding to the amplitudes of a corresponding number of evenly spaced reference points defining the waveform of one full cycle of an audio signal are transferred sequentially from a note register having first and second sections to a digital-to-analog converter in repetitive cycles at a rate proportional to the pitch of the tone being generated, apparatus for loading a new set of data words in the note register, comprising: means storing a first group of data words corresponding to reference points defining the waveform of half a cycle of an audio signal, means transferring the first group of data words in a first sequence from said means storing the first group of data words to said first section of the note register, means transferring said first group of words in sequence to said second section of the note register in reverse sequence after completion of the transfer to said first section, and means repetitively transferring all the words in the first section of the note register followed by all the words in the second section a word at a time to the converter at a rate proportional to said pitch frequency, the transfer of words from the note register to the converter continuing without interruption from one section of the note register while words are transferred to the other section of the note register from said means storing a first group of data words, the transfer rate of words to the note register from said means storing a first group of data words being higher than the rate the words are transferred to the converter.

7. Apparatus of claim 6 wherein said means transferring the first group of data words transfers each word in said first group simultaneously to both the first and second sections of the note register.

8. Apparatus of claim 7 wherein said means transferring the first group of data words to the first section of the note register transfers all the words in the group in a time less than the time between the transfer of successive words from the note register to the converter.

9. Apparatus of claim 6 wherein the means transferring words to the second section includes means transferring the words from the first section to the second section simultaneously with transferring the words from the first section to the converter.

* * * * *